United States Patent [19]

Christolini et al.

[11] Patent Number: 5,013,428

[45] Date of Patent: May 7, 1991

[54] RECOVERY OF OIL FROM A SHALE CONTAINING THE SAME

[75] Inventors: Ben A. Christolini, Yorba Linda; Kimanh T. Le, Corona; Mitchell J. Berndt, Placentia; Steven E. Howe, Chino, all of Calif.

[73] Assignee: Union Oil Company of California, Los Angeles, Calif.

[21] Appl. No.: 504,937

[22] Filed: Apr. 5, 1990

[51] Int. Cl.[5] ..... C10G 1/00

[52] U.S. Cl. ..... 208/415; 208/390; 208/400; 208/424; 208/428; 208/434; 208/435

[58] Field of Search ..... 208/415, 424, 428, 434, 208/435, 390, 400

[56] References Cited

U.S. PATENT DOCUMENTS 3,228,869 1/1966 Irish ..... 208/415
4,057,486 11/1977 Meadus et al. ..... 208/415
4,376,693 3/1983 Wanzel ..... 208/415
4,773,988 9/1988 Delaney ..... 208/424

*Primary Examiner*—Anthony McFarlane
*Assistant Examiner*—Nhat Phan
*Attorney, Agent, or Firm*—Clark E. De Larvin; Gregory F. Wirzbicki

[57] ABSTRACT

Enhanced recovery of oil from an oil-containing particulate shale sludge is achieved by contacting the sludge with a light hydrocarbon solvent fraction, obtained from the processing of oil derived from the shale, in the presence of water to form an oil-solvent liquid phase which is separated from an aqueous phase containing oil-depleted shale. The oil-solvent liquid phase when introduced into a slurry of product oil and particulate contained within a shale retort provides several advantages, including lowering the viscosity of the product oil and enhanced separation of the product oil from the particulate shale.

29 Claims, 1 Drawing Sheet

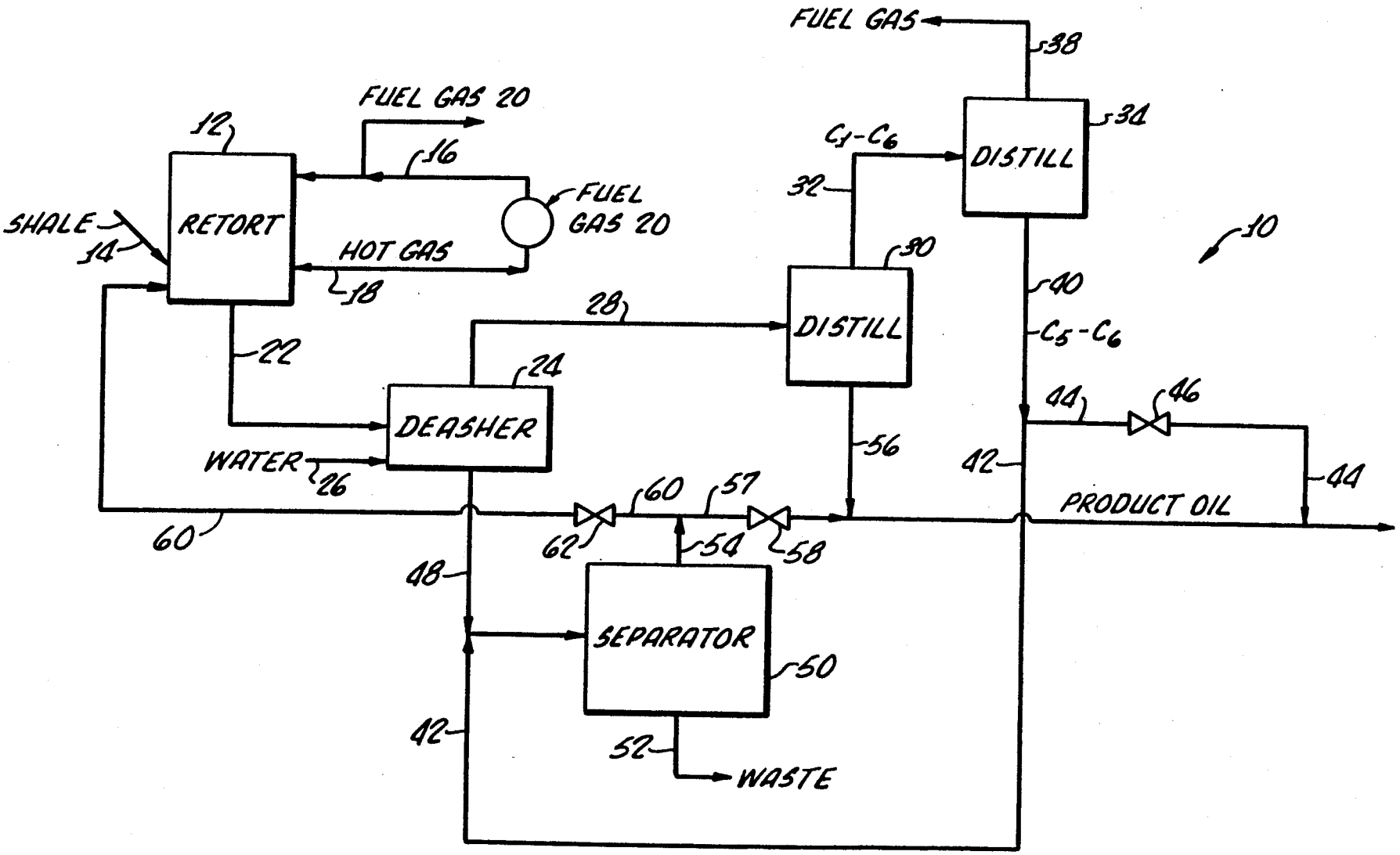
10
RETORT
12
SHALE
14
HOT GAS
18
FUEL GAS 20
16
FUEL GAS 20
22
DEASHER
24
WATER
26
28
60
DISTILL
30
C1-C6
32
DISTILL
34
FUEL GAS
38
C5-C6
40
42
44
46
PRODUCT OIL
56
57
58
54
60
62
SEPARATOR
50
WASTE
52
48
42

RECOVERY OF OIL FROM A SHALE CONTAINING THE SAME

FIELD OF THE INVENTION

The present invention broadly relates to the recovery of oil from an oil containing shale. The invention particularly relates to a process in which oil entrained in a sludge produced during the processing of oil shale is treated with a hydrocarbon stream to recover the entrained oil.

BACKGROUND OF THE INVENTION

A great many methods have previously been proposed for recovering oil from oil shale, nearly all of which involve some form of pyrolytic eduction. For a variety of economic reasons, none of these methods has yet proven competitive with the production of oil from petroleum or other fossil sources. In general, the principal overall difficulty involved in shale oil eduction resides in recovering essentially all of the hydrocarbonaceous material from the shale without resorting to prohibitively expensive methods. Since shale rock usually contains only about 20–80 gallons of oil per ton, it is a practical necessity to recover at least about 80 to 90% of this oil and to do so in the most economical fashion. It is not essential that all of this oil be recovered as a liquid product. Combustible gas products can also be economically utilized in the eduction process itself or in any other way where a source of heat is required. Nonetheless, the overall objective remains to recover the maximum possible energy values at minimum expense.

Perhaps the most widely used basic concept in oil shale retorting involves countercurrently contacting a stream of crushed oil shale with a stream of preheated eduction gas. In this manner a temperature gradient is set up in a moving shale bed which includes a hot eduction zone near the gas inlet to the retort and an oil condensation, shale preheating zone near the shale inlet end of the retort.

Two methods are commonly used, a solids-downflow mode of operation and a solids upflow mode of operation. In the solids-upflow, gas-downflow method, oil shale is fed upwardly through a vertical retort by means of a reciprocating piston. The upwardly moving shale bed continuously exchanges heat with a downflowing high specific heat, hydrocarbonaceous recycle gas introduced into the top of the retort at a temperature in the range of 950° to 1200° F. In the upper section of the retort (the pryolysis zone), the hot recycle gas educes hydrogen and hydrocarbonaceous vapors from the shale. In the lower section of the retort, the oil shale is preheated to pyrolysis temperature by exchanging heat with the mixture of recycle gases and educed product vapors. The product vapors are continually swept away from the hot pyrolysis zone and the heavier hydrocarbons therein condense in the lower portion of the retort. These heavy hydrocarbons are collected at the bottom of the retort as product oil. The remaining uncondensed gas is passed out of the retort through external condensing or demisting means to obtain more product oil. The remaining oil-free gases are then utilized as recycle gas to carry heat into the shale bed as above described and as fuel gas to preheat the recycle gas up to the above specified temperatures.

The product oil is recovered from the retort and further processed to remove solids therefrom. This generally is accomplished by what is referred to as deashing. As its name implies, deashing is accomplished in a deasher typically comprising an electrostatic coalescer which separates the oil from the retort into two fractions, a substantially pure product oil fraction and a sludge fraction containing entrained oil. Attempts have been made to remove the remaining entrained oil using centrifuges and the like. However, such attempts have met with only marginal success, removing only 10 to 20 percent of the entrained oil.

SUMMARY OF THE INVENTION

A process is provided for the recovery of oil from a shale containing the same. A pulverized, oil-containing shale is introduced into a retort zone to produce a slurry of shale and crude oil. The slurry of shale and crude oil is withdrawn and introduced into a deashing zone in the presence of water. In the deashing zone a substantially shale free crude oil and an aqueous emulsion comprising particulate shale containing entrained crude oil. The substantially shale free crude oil is further processed to produce a product oil and a light liquid hydrocarbon solvent. At least a substantial portion of the light hydrocarbon solvent is recovered and contacted with the emulsion of shale containing entrained crude oil for a time sufficient to extract crude oil from the emulsion. After extraction, a mixture of crude oil and solvent is recovered from the aqueous oil-depleted emulsion.

In accordance with a preferred embodiment of the invention, the solvent comprises naphtha and substantially all of it is used for contacting the particulate shale containing entrained crude oil to further enhance recovery of the crude oil. In accordance with another embodiment of the invention, the mixture of crude oil and light hydrocarbon solvent is recycled to the crude oil in the retort where it reduces the viscosity of the crude oil contained therein. Another advantage of this particular embodiment is that, when the oil of reduced viscosity is subsequently deashed, the shale fraction contains substantially less entrained oil.

BRIEF DESCRIPTION OF THE DRAWINGS

The drawing is a simplified schematic flow diagram illustrating a preferred mode in which the process of this invention is practiced.

DETAILED DESCRIPTION

Any of a large number of naturally occurring oil producing shale material can be used herein. The characteristics of these materials are generally well known and hence need not be described in detail. For practical purposes, however, the raw shale should contain at least about 10 and preferably between about 25 and 75 gallons of oil per ton of raw shale as determined by Fischer assay. The shale should be crushed to produce a raw feed having no particles greater than 6 inches and preferably none greater than 3 inches mean diameter, average particle sizes of about ⅛ to 2 inches mean diameter preferred.

Referring now to FIG. 1 a pulverized shale feed is introduced into a retort 12 through a shale feeder 14. The raw shale passes upwardly through retort 12 traversing a lower preheating zone and an upper pyrolysis zone. Temperatures in the lower portion of the retort are sufficiently low to condense product oil vapors from the super adjacent pyrolysis zone. As the shale progresses upwardly through the retort its temperature is gradually increased to eduction levels by countercurrently flowing eduction gases, which include a preheated, recycle portion of retort produced gas, introduced through line 16. Recycle gas is withdrawn from a lower portion of retort 12 via line 18 and passed in indirect heat exchange relationship with a source of heat 20, typically an indirect, gas fired, heat exchanger. Eduction gas temperatures generally are within the range of from about 700° F. to 1300° F. and preferably between about 900° F. and 1200° F.

All but a minor part of the oil will have been educed from the shale by the time it reaches a temperature of about 1000° F. Other typical retorting conditions include shale residence times in excess of about 10 minutes and usually about 30 minutes to 2 hours to educe the maximum amount of oil at the selected retort temperatures. Shale feed rates usually exceed about 100 and are preferably about 1000 to 2000 pounds per hour per square foot of cross-sectional area in the retort. Pressure in the retort may be either subatmospheric, atmospheric or superatmospheric. Generally preferred retorting pressures are in the range of from about 10 to 25 psig.

The gas produced in retort 12 is withdrawn and further processed for removal of any oil contained therein (not shown). The majority of the gas is recycled to the retort. The balance of the gas is used as a fuel gas for heat for the process.

A slurry of oil and shale is withdrawn via line 22 and introduced into a deasher unit 24. Typically, deasher 24 comprises an electrostatic precipitator or coalescer. In addition to the slurry from retort 12, water also is introduced into deasher 24 through line 26 to produce two phases, an oil phase and a water phase. The shale and other solids separate into the water phase. Typically, the water is introduced in an amount to provide from about 5 to 15 and preferably about 10 volume percent of water, based on the volume of slurry introduced through line 22. Deasher 24 generally is operated at a temperature within the range from about 200° to 300° F. and a pressure of about 200 to 250 psig. The increased pressure is required to prevent the water from being converted to steam, which would be deleterious to obtaining the desired phase separation of shale from the oil.

From an upper portion of deasher 24 a stream of oil substantially free of the particulate shale, is withdrawn through line 28 for introduction into distillation unit 30. In distillation unit 30 the oil is separated into two fractions. A light gaseous fraction containing $C_1$ to $C_6$ hydrocarbon, is withdrawn from an upper portion of distillation unit 30 through line 32 for introduction into a second distillation unit 34. From a lower portion of distillation unit 30 a liquid product oil is withdrawn through line 36, which consists essentially of $C_7$+ hydrocarbons.

In the second distillation unit 34, the light gaseous fraction of $C_1$ to $C_6$ hydrocarbons introduced therein is separated into two fractions. An overhead fraction, comprising a fuel gas, is withdrawn via line 38. A bottoms liquid fraction consisting essentially of a light ($C_5$ and $C_6$) hydrocarbon solvent is withdrawn via line 40. Advantageously all or at least 75 percent of the light hydrocarbon solvent withdrawn via line 40 is recycled to the process via line 42. In some instances, however, it may be advantageous to withdraw a portion of the light hydrocarbon solvent passing through line 40 for addition to the product oil, and this is readily accomplished via line 44 and valve 46.

In deasher 24, a sludge or slurry is withdrawn through line 48 which is introduced into a separator 50. The sludge comprises a mixture of water, shale and oil. The crude oil produced in the retort is entrained in the sludge as a coating on the shale particles and as an oil in water emulsion. Typically the sludge consists essentially of a major amount of water and a minor amount of crude oil and particulate shale. The volume ratio of oil to shale is greater than about 1.5:1 and generally is greater than about 2:1. Typically, the sludge or slurry will have a composition of approximately 28 volume percent oil, 11 volume percent particulate solids, and 61 volume percent water.

It has been found that the slurry comprises a stable emulsion in which the oil is tightly bound. The emulsion is so stable that substantially no oil is recoverable therefrom by conventional mechanical means. The present invention provides a process for breaking up the emulsion to facilitate the recovery of oil therefrom.

Preferably, just prior to the slurry being introduced into separator 50 it is mixed with the recycled stream of light hydrocarbon solvent from line 42. Advantageously, the mixing is accomplished utilizing a mixing valve or static mixing spool (not shown). The light hydrocarbon solvent, generally referred to as naphtha, is recycled in an amount to provide a volume ratio of sludge (water, oil and shale) to naphtha within the range of 4:1 to 1:4, preferably 3:1 to 1:3, and most preferably 2:1 to 1:2.

The temperature and pressure within separator 50 are generally substantially similar to those in deasher 24. Typically the temperature will be maintained within the range of from about 100° F. to 400° F. and preferably from about 200° F. to 300° F. To maintain the water in a liquid phase, the pressure generally is maintained in the range of from about 200 to 400 psig and preferably from about 200 to 300 psig.

The recycled light hydrocarbon solvent and sludge are maintained in separator 50 for a time sufficient to achieve a desired amount of separation between the water and solids, and oil. The time is not particularly critical. It is an advantage of the present invention that a substantial amount of separation takes place quite rapidly. Indeed, in excess of about 80 percent of the total separation achievable (under the conditions shown in the Example) is generally obtained in a time of about 12 minutes. There is no upper limit on time other than that dictated by economics and practicality. Accordingly, the residence time in separator 50 will generally be within the range from about 0.5 to 5 hours and preferably within the range of from about 1 to 2 hours.

It has been found that, within the range of volume ratios of sludge to light hydrocarbon solvent and within the time ranges specified, the recovery of at least 60 percent of the entrained oil is readily accomplished. By optimization of such ratios, time and temperature, oil recoveries generally in excess of 75 percent and typically in the range of 70 to 85 percent are readily obtainable.

A substantially oil depleted fraction principally comprising solids and water is withdrawn via line 52 for disposal. A substantially water and solids free fraction, consisting essentially of the entrained oil and the recycled light hydrocarbon solvent, is withdrawn via line 54. A portion of the oil and light hydrocarbon solvent may be blended with the product oil removed from distillation unit 30 via line 56, line 57 and valve 58.

Advantageously, however, a substantial portion is recycled to retort 12 via line 60 and valve 62.

A substantial benefit is obtained by recycling the oil-light hydrocarbon solvent to the slurry of oil and pulverized shale contained in a lower portion of the retort. It lowers the viscosity of the oil in the slurry, making the slurry less subject to solidification should there be a drop in temperature. Another benefit is that a higher percentage of oil is recovered from the shale in deasher 24. Generally, at least half of the oil-light hydrocarbon solvent fraction, preferably in excess of 75%, and even more preferably in excess of 90% is recycled to the oil slurry in the retort.

EXAMPLE

A series of gravity settling experiments was performed on mixtures of an oil shale deasher sludge and various amounts of selected additives. The additives were light hydrocarbons ($C_5$ to $C_6$), light oils, calcium oxide and calcium chloride. The sludge comprised an emulsion of approximately 25 percent oil, 11 percent solids and 61 percent water.

Samples of the deasher sludge were mixed with the selected additive and allowed to settle in 100 ml centrifuge tubes at ambient temperature and pressure. The amount of oil which separated from the sludge was recorded as a function of time. After several days the samples were centrifuged for 10 minutes to determine the maximum oil separation that could be expected from that sample. For comparative purposes a sample of deasher sludge without any additive was subjected to the same test.

The emulsion was so stable that after two hours no oil had separated from the sample without any additive. Indeed, after seventy two hours, less than about 10 percent was separated from this sample by the centrifuge.

Neither calcium oxide nor calcium chloride appeared to produce any measurable benefit in the sludge samples to which they were added. Oil separation in these samples was substantially the same as that of the sample without any additive.

The use of light oil as an additive provided some measurable benefit. At a sludge to oil ratio of 1:1, a settling time in excess of two hours was required to obtain separation of approximately 60 percent of the oil. Thus, the use of a light oil would not be economically effective.

The results of tests of sludge samples and light hydrocarbons of the present invention were substantially better. At a sludge to hydrocarbon ratio of 3:1, in excess of 60 percent oil separation was obtained in about one-half hour. At a sludge to hydrocarbon ratio of 1:1, in excess of 80 percent oil separation was observed in a time of only about 10 minutes. Clearly the present invention provides an economically effective process for the recovery of oil from a deasher sludge and eliminates the need for costly mechanical separation devices such as hydrocyclones and centrifuges.

From the foregoing description of what is now considered to be the best mode of practicing the present invention, it will be apparent that there are numerous changes, adaptations and modifications which may be made. It is intended that all such variations be considered as within the scope of the claims appended hereto.

What is claimed is:

1. A process for recovering oil from a shale containing the same comprising the steps of:

(a) introducing a pulverized oil-containing shale into a retort zone to produce a slurry comprising shale particulates and oil;

(b) introducing the slurry from step (a) into a deashing zone and separating the slurry into a substantially shale-free oil fraction and a shale fraction containing entrained oil;

(c) separating the shale-free oil fraction from step (b) into at least a product oil fraction and a light hydrocarbon solvent; and (d) contacting the shale fraction from step (b) with at least a portion of the light hydrocarbon solvent from step (c) for a time sufficient to produce an oil-solvent mixture and an oil depleted shale fraction.

2. The process of claim 1 wherein in step (d) the time is from about 0.5 to 5 hours.

3. The process of claim 1 wherein in step (d) the light hydrocarbon is present in an amount to provide a volume ratio of shale to light hydrocarbon solvent of from about 4:1 to 1:4.

4. The process of claim 1 wherein at least 75 percent of the light hydrocarbon solvent produced in step (c) is introduced into step (d).

5. The process in claim 1 wherein in step (d) in excess of 60 percent of the entrained oil is recovered from the shale fraction.

6. The process in claim 1 wherein the light hydrocarbon solvent from step (c) comprises $C_5$ to $C_6$ hydrocarbons.

7. The process in claim 1 wherein the oil-solvent mixture fraction from step (d) is introduced into the retort and mixed with the slurry of shale and oil collected in the retort in step (a).

8. A process for recovering oil from a shale containing the same comprising the steps of:

(a) introducing a pulverized oil-containing shale having an average particle size of from about $\frac{1}{8}$ to 2 inches mean diameter into a retort zone maintained at a temperature of from about 950° F. to 1200° F. to produce a slurry of shale and oil;

(b) introducing the slurry from step (a) into a deashing zone and separating the slurry into a substantially shale-free oil fraction and a shale fraction containing entrained oil;

(c) separating the oil fraction from step (b) into a product oil fraction and a light hydrocarbon solvent fraction; and (d) contacting the shale fraction from step (b) with at least a portion of the light hydrocarbon solvent fraction from step (c) for a time sufficient to produce an oil-solvent mixture and an oil depleted shale fraction.

9. The process of claim 8 wherein in step (d) the time is from about 1 to 2 hours.

10. The process of claim 9 wherein in step (d) the solvent fraction comprises a liquid present in an amount to provide a volume ratio of shale to solvent fraction of from about 3:1 to 1:3.

11. The process of claim 10 wherein at least 75 percent of the light hydrocarbon solvent produced in step (c) is introduced into step (d).

12. The process in claim 11 wherein in step (d) in excess of 60 percent of the entrained oil is recovered from the shale fraction.

13. The process in claim 10 wherein the light hydrocarbon solvent fraction from step (c) consists essentially of $C_5$ to $C_6$ hydrocarbons.

14. The process in claim 9 wherein a major portion of the oil-light hydrocarbon fraction from step (d) is introduced into the slurry of shale and oil in a lower portion of the retort in step (a).

15. A process for recovering oil from an oil-shale slurry comprising the steps of: (a) introducing the slurry into a deashing zone and separating the slurry into a substantially shale-free oil fraction and a shale fraction containing entrained oil;

(b) separating the oil fraction from step (a) into a product oil fraction and a light hydrocarbon solvent fraction; and (c) contacting the shale fraction from step (a) with at least a portion of the light hydrocarbon solvent fraction from step (b) for a time sufficient to produce a mixture of oil and light hydrocarbon solvent, and an oil depleted shale fraction.

(d) recovering the oil-solvent mixture.

16. The process of claim 15 wherein in step (c) the time is from about 1 to 2 hours.

17. The process of claim 16 wherein in step (c) the light hydrocarbon solvent fraction is present in an amount to provide a volume ratio of shale to solvent of from about 2:1 to 1:2.

18. The process of claim 17 wherein at least 75 percent of the light hydrocarbon solvent fraction produced in step (b) is introduced into step (c).

19. The process in claim 18 wherein a portion of the oil-light hydrocarbon fraction from step (c) is added to the product oil fraction of step (b).

20. The process in claim 18 wherein in step (c) in excess of 60 percent of the entrained oil is recovered from the shale fraction.

21. An oil recovery process comprising: providing a mixture of a pulverized shale containing entrained oil, water and a light hydrocarbon solvent in an oil recovery zone maintained at a superambient temperature and superatmospheric pressure, containing said mixture in the zone for a time sufficient to effect a phase separation into an oil-solvent rich phase and a shale-containing water rich phase, and recovering the oil-solvent rich phase.

22. The process of claim 21 wherein the time is from about 1 to 2 hours.

23. The process of claim 22 wherein the light hydrocarbon solvent is present in an amount to provide a volume ratio of shale to solvent of from about 2:1 to 1:2.

24. The process in claim 23 wherein in excess of 60 percent of the entrained oil is recovered from the shale fraction.

25. The process in claim 23 wherein the light hydrocarbon solvent comprises $C_5$ to $C_6$ hydrocarbons.

26. The process in claim 25 wherein the temperature in the oil recovery zone is within the range of from about 200° F to 300° F.

27. The process in claim 26 wherein the pressure in the oil recovery zone is within the range of from about 200 to 300 psig.

28. The process in claim 27 wherein the light hydrocarbon is obtained from the distillation of a crude shale oil.

29. The process in claim 28 wherein the oil-solvent rich phase recovered is introduced into an oil shale retort and mixed with a slurry of oil and particulate shale contained therein.

* * * * *